US009550080B2

(12) United States Patent
Stehman et al.

(10) Patent No.: US 9,550,080 B2
(45) **Date of Patent: *Jan. 24, 2017**

(54) SUPPRESSING A FIRE CONDITION IN AN AIRCRAFT

(71) Applicant: United Parcel Service of America, Inc., Atlanta, GA (US)

(72) Inventors: Keith M. Stehman, Louisville, KY (US); John H. Ransom, Jr., Alpharetta, GA (US)

(73) Assignee: UNITED PARCEL SERVICE OF AMERICA, INC., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/175,067

(22) Filed: Feb. 7, 2014

(65) Prior Publication Data

US 2014/0151072 A1 Jun. 5, 2014

Related U.S. Application Data

(63) Continuation-in-part of application No. 13/458,575, filed on Apr. 27, 2012.

(Continued)

(51) Int. Cl.

*A62C 3/08* (2006.01)
*A62C 3/00* (2006.01)

(Continued)

(52) U.S. Cl.

CPC ..... *A62C 3/08* (2013.01); *A62C 5/006* (2013.01); *A62C 2/24* (2013.01); *A62C 2/246* (2013.01);

(Continued)

(58) Field of Classification Search

CPC ..... A62C 3/00; A62C 2/00; A62C 35/00; A62C 3/06; A62C 3/07; A62C 3/08; A62C 99/00; A62C 99/0009; A62C 99/0018; A62C 2/24; A62C 2/246; A62C 2/247; A62C 2/248

(Continued)

(56) References Cited

U.S. PATENT DOCUMENTS 4,643,260 A * 2/1987 Miller ..... A62C 3/08 169/46
4,763,115 A 8/1988 Cota (Continued)

FOREIGN PATENT DOCUMENTS

CN 1514743 A 7/2004
CN 101801467 A 8/2010

(Continued)

OTHER PUBLICATIONS

United States Patent and Trademark Office, Office Action for U.S. Appl. No. 13/296,563, filed Jun. 16, 2014, 23 pages, USA.

(Continued)

*Primary Examiner* — Arthur O Hall
*Assistant Examiner* — Christopher R Dandridge
(74) *Attorney, Agent, or Firm* — Alston & Bird LLP

(57) ABSTRACT

Various concepts are provided for suppressing a fire condition in an aircraft. In one embodiment, the presence of a fire condition in an aircraft is detected. After such a detection, extinguishing agents can be dispensed and/or certain areas of the aircraft can be depressurized.

5 Claims, 8 Drawing Sheets

Related U.S. Application Data

(60) Provisional application No. 61/498,018, filed on Jun. 17, 2011.

(51) Int. Cl.
*A62C 2/24* (2006.01)
*A62C 5/00* (2006.01)

(52) U.S. Cl.
CPC ..... *A62C 2/247* (2013.01); *A62C 2/248* (2013.01); *A62C 3/00* (2013.01)

(58) Field of Classification Search
USPC ..... 169/43, 45, 46, 11, 54, 56, 60, 61, 62, 53,169/70
See application file for complete search history.

(56) References Cited

U.S. PATENT DOCUMENTS

| | | | | |
|---|---|---|---|---|
| 5,062,151 | A | 10/1991 | Shipley | |
| 5,822,544 | A | 10/1998 | Chaco et al. | |
| 6,003,608 | A * | 12/1999 | Cunningham | A62C 3/08 169/46 |
| 6,029,751 | A | 2/2000 | Ford et al. | |
| 6,518,878 | B1 | 2/2003 | Skoff | |
| 6,721,640 | B2 | 4/2004 | Glenn et al. | |
| 6,899,184 | B2 | 5/2005 | Reynolds | |
| 7,066,274 | B2 * | 6/2006 | Lazzarini | 169/54 |
| 7,456,750 | B2 | 11/2008 | Popp et al. | |
| 7,501,958 | B2 | 3/2009 | Saltzstein et al. | |
| 7,592,916 | B2 | 9/2009 | Staples | |
| 8,054,200 | B1 | 11/2011 | Nelson | |
| 8,322,658 | B2 * | 12/2012 | Gershzohn et al. | 244/129.2 |
| 8,863,856 | B2 | 10/2014 | Eckholm et al. | |
| 2001/0054964 | A1 | 12/2001 | Popp et al. | |
| 2004/0020665 | A1 | 2/2004 | Gupta | |
| 2004/0163826 | A1 | 8/2004 | Spring | |
| 2008/0257566 | A1 | 10/2008 | Shattuck | |
| 2008/0314603 | A1 * | 12/2008 | Lazzarini | B64D 25/00 169/62 |
| 2009/0038811 | A1 | 2/2009 | Wagner | |
| 2010/0236796 | A1 * | 9/2010 | Chattaway | A62C 37/44 169/46 |
| 2011/0048747 | A1 | 3/2011 | Gastonides et al. | |
| 2011/0240798 | A1 * | 10/2011 | Gershzohn | G08B 17/00 244/129.2 |
| 2012/0168184 | A1 * | 7/2012 | Enk, Sr. | A62C 3/08 169/14 |
| 2012/0318537 | A1 | 12/2012 | Ransom, Jr. | |
| 2013/0000927 | A1 * | 1/2013 | Meier et al. | 169/46 |
| 2013/0120162 | A1 | 5/2013 | Stehman et al. | |
| 2015/0075823 | A1 * | 3/2015 | Meier | A62C 3/08 169/46 |

FOREIGN PATENT DOCUMENTS

| | | | |
|---|---|---|---|
| CN | 101843963 | A | 9/2010 |
| CN | 102000406 | A | 4/2011 |
| EP | 2740517 | A2 | 6/2014 |
| GB | 2374007 | A | 10/2002 |

OTHER PUBLICATIONS

United States Patent and Trademark Office, Office Action for U.S. Appl. No. 13/296,563, filed Feb. 18, 2015, 29 pages, USA
United States Patent and Trademark Office, Office Action for U.S. Appl. No. 13/458,575, Jan. 29, 2015, 15 pages, USA.
State Intellectual Property Office, Search Report for Chinese Application No. 2012800259890, Jan. 21, 2015, 5 pages, China.
International Searching Authority, International Search Report and Written Opinion for International Application No. PCT/US2014/064755, Feb. 6, 2015, 10 pages, European Patent Office, The Netherlands.
United States Patent and Trademark Office, Office Action for U.S. Appl. No. 13/296,563, Aug. 18, 2015, 29 pages, USA.
United States Patent and Trademark Office, Office Action for U.S. Appl. No. 13/458,575, Aug. 5, 2015, 11 pages, U.S.A.
European Patent Office, Extended European Search Report for Application No. 15168848.8, Feb. 17, 2016, 6 pages, Germany.
United States Patent and Trademark Office, Office Action for U.S. Appl. No. 13/458,575, Feb. 9, 2016, 12 pages, U.S.A.
United States Patent and Trademark Office, Office Action for U.S. Appl. No. 13/296,563, Feb. 17, 2016, 25 pages, U.S.A.
United States Patent and Trademark Office, Office Action for U.S. Appl. No. 13/458,575, Jun. 29, 2016, 9 pages, U.S.A.
State Intellectual Property Office of the P.R.C., Third Office Action for Application No. 2012800259890, Apr. 18, 2016, 6 pages, U.S.A.
International Searching Authority, International Search Report and Written Opinion for International Application No. PCT/US2012/035928, mailed Apr. 3, 2013, 11 pages, European Patent Office, The Netherlands.
International Preliminary Examining Authority, International Preliminary Report on Patentability for International Application No. PCT/US2012/035928, mailed Sep. 24, 2013, 7 pages, European Patent Office, The Netherlands.
United States Patent and Trademark Office, Office Action for U.S. Appl. No. 13/296,563, Jun. 28, 2013, 16 pages, USA.
United States Patent and Trademark Office, Office Action for U.S. Appl. No. 13/296,563, Feb. 5, 2014, 27 pages, USA.
United States Patent and Trademark Office, Notice of Allowance for U.S. Appl. No. 13/458,575, Oct. 14, 2016, 11 pages, U.S.A.
State Intellectual Property of the People's Republic of China, Fourth Office Action for Application No. 201280025989.0, Sep. 23, 2016, 25 pages, China.

* cited by examiner

SUPPRESSING A FIRE CONDITION IN AN AIRCRAFT

CROSS-REFERENCE TO RELATED APPLICATIONS

This application is a continuation-in-part of U.S. patent application Ser. No. 13/458,575 filed on Apr. 27, 2012, which claims priority to U.S. Patent Application Ser. No. 61/498,018 filed on Jun. 17, 2011, the entireties of both applications are hereby incorporated herein by reference.

BACKGROUND

One of the most hazardous situations a flight crew can face is a fire while the aircraft is airborne. Without aggressive intervention by the flight crew and/or fire-suppression system installed on the aircraft, an onboard fire during flight can lead to a catastrophic loss of the aircraft within a very short time.

Today, some aircraft compartments have fire-suppression systems to deal with a fire that may occur in one or more of the compartments. Such fire-suppression systems typically disperse an extinguishing agent (e.g., liquefied gas) such as Halon 1211, Halon 1301, or combination thereof to suppress the fire. In many instances, the systems are configured to release a rapid discharge of the extinguishing agent to provide a high concentration level of the agent in order to achieve a fast flame knockdown. For example, the rapid discharge may be achieved by releasing the entire contents of one or more pressurized containers (e.g., bottles) of the agent into the compartments.

Further, in particular instances, many systems are configured to follow the rapid discharge with a maintained concentration of an extinguishing agent at some reduced level in the container area in order to sustain fire suppression. For example, the concentration of the extinguishing agent may be maintained in the compartment or compartment by providing a substantially continuous, regulated flow of the agent from one or more pressurized containers over a period of time.

Another tactic typically employed if a fire is detected in an aircraft during flight is to land the aircraft as-soon-as-possible. Thus, when the aircraft descends, the compartments of the aircraft normally undergo a repressurization. In addition, the containers may also experience an increase in leakage. In many instances, the repressurization and increased leakage may cause additional air to be presented into the container and as a result, the concentration of the extinguishing agent may decrease as the aircraft descends. Therefore, many fire-suppression systems may compensate for the decrease in concentration during descent by maintaining a higher concentration of the agent in the container during cruise before the descent of the aircraft. For instance, the fire-suppression systems may discharge a second high concentration level of the agent into the compartment as the aircraft begins its descent.

Thus, in instances in which the system provides the multiple discharges of suppression agent, the conventional fire-suppression system must contain enough extinguishing agent to provide the initial rapid discharge, to maintain the concentration during the flight time, and to provide an optional second rapid discharge upon the aircraft beginning its descent. Therefore, a drawback to many conventional fire-suppression systems is that such systems must carry hundreds of pounds of extinguishing agent(s) on each flight to ensure that the fire-suppression systems will have enough agent to meet the concentration level requirements at all times in the event a fire condition occurs in one or more of the compartments of the aircraft. The weight of the agent negatively impacts the aircraft's fuel efficiency. Therefore, a need exists in the art for improved systems and methods that require aircraft to carry less extinguishing agent during a flight and still ensure adequate fire-suppression capabilities. Further, a need exists in the art for improved suppression agents that may improve upon the fire suppression capabilities of traditional fire suppression agents.

BRIEF SUMMARY

In general, embodiments of the present invention provide aspects for fire suppression aboard an aircraft.

In accordance with one aspect, a method for suppressing a fire condition in an aircraft is provided. In one embodiment, the method comprises (1) detecting a presence of a fire condition in a compartment of an aircraft; (2) after detecting the presence of the fire condition in the compartment of the aircraft, depressurizing the compartment of the aircraft; and (3) after depressurizing the compartment of the aircraft, releasing a first discharge of an extinguishing agent in the compartment of the aircraft.

In accordance with another aspect, a method for suppressing a fire condition in an aircraft is provided. In one embodiment, the method comprises (1) detecting a presence of a fire condition in a compartment of an aircraft; (2) after detecting the presence of the fire condition in the compartment of the aircraft, releasing a first discharge of an extinguishing agent in the compartment of the aircraft; (3) depressurizing the compartment of the aircraft; and (4) after depressurizing the compartment of the aircraft, releasing a second discharge of the extinguishing agent in the compartment of the aircraft.

In accordance with yet another aspect, a method for suppressing a fire condition in an aircraft is provided. In one embodiment, the method comprises (1) detecting a presence of a fire condition in a compartment of an aircraft; (2) after detecting the presence of the fire condition in the compartment of the aircraft, releasing a first discharge of an extinguishing agent in the compartment of the aircraft; and (3) after releasing the first discharge of the extinguishing agent (a) releasing a second discharge of the extinguishing agent in the compartment of the aircraft and (b) depressurizing the compartment of the aircraft.

In accordance with one aspect, a compartment for suppressing a fire condition in an aircraft is provided. In one embodiment, the compartment may comprise one or more fire detectors adapted to detect fire conditions and one or more containers adapted to release an extinguishing agent. The compartment may be adapted to (1) detect a presence of a fire condition in the compartment aboard an aircraft, wherein at least one area of the aircraft is depressurized after detecting the presence of the fire condition; and (2) after the at least one area of the aircraft is depressurized, release a first discharge of an extinguishing agent in the compartment.

In accordance with another aspect, a compartment for suppressing a fire condition in an aircraft is provided. In one embodiment, the compartment may comprise one or more fire detectors adapted to detect fire conditions and one or more containers adapted to release an extinguishing agent. The compartment may be adapted to (1) detect a presence of a fire condition in the compartment aboard an aircraft; (2) after detecting the presence of the fire condition in the compartment aboard the aircraft, release a first discharge of an extinguishing agent in the compartment of the aircraft;

and (3) after at least one area of the aircraft is depressurized in response to detecting the presence of the fire condition, release a second discharge of the extinguishing agent in the compartment of the aircraft.

In accordance with still another aspect, a compartment for suppressing a fire condition in an aircraft is provided. In one embodiment, the compartment may comprise one or more fire detectors adapted to detect fire conditions and one or more containers adapted to release an extinguishing agent. The compartment may be adapted to (1) detect a presence of a fire condition in the compartment aboard an aircraft; (2) after detecting the presence of the fire condition in the compartment aboard the aircraft, release a first discharge of an extinguishing agent in the compartment of the aircraft; and (3) after releasing the first discharge of the extinguishing agent, release a second discharge of the extinguishing agent in the compartment of the aircraft while at least one area of the aircraft is depressurized in response to detecting the presence of the fire condition.

BRIEF DESCRIPTION OF THE SEVERAL VIEWS OF THE DRAWING(S)

Having thus described the present invention in general terms, reference will now be made to the accompanying drawings, which are not necessarily drawn to scale, and wherein:

FIG. 1 illustrates a perspective view of an aircraft with compartments in accordance with an embodiment of the present invention.

FIGS. 2, 7, and 8 illustrates schematic views of fire-suppression systems according to various embodiments of the present invention.

Figure 6:
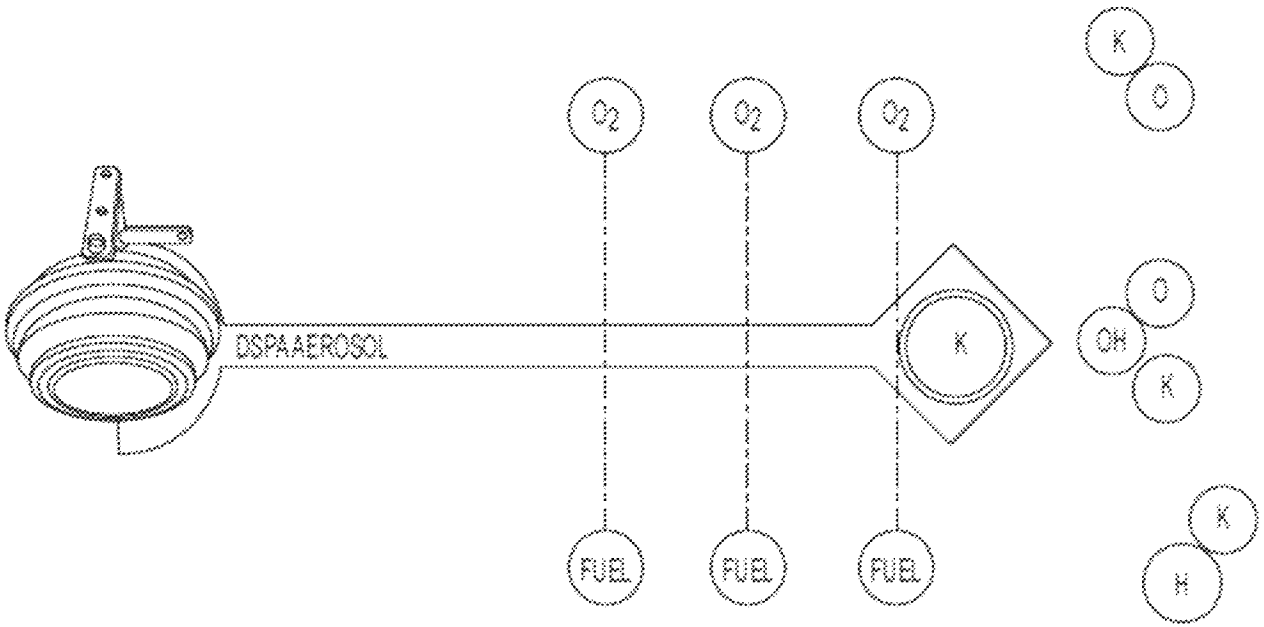

FIG. 6 further illustrates the use of dry sprinkler powder aerosol as an extinguishing agent in various embodiments of the present invention.

DETAILED DESCRIPTION

Various embodiments of the present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. The term "or" is used herein in both the alternative and conjunctive sense, unless otherwise indicated. The terms "illustrative" and "exemplary" are used to be examples with no indication of quality level. Like numbers refer to like elements throughout.

Exemplary Systems

Figure 1:
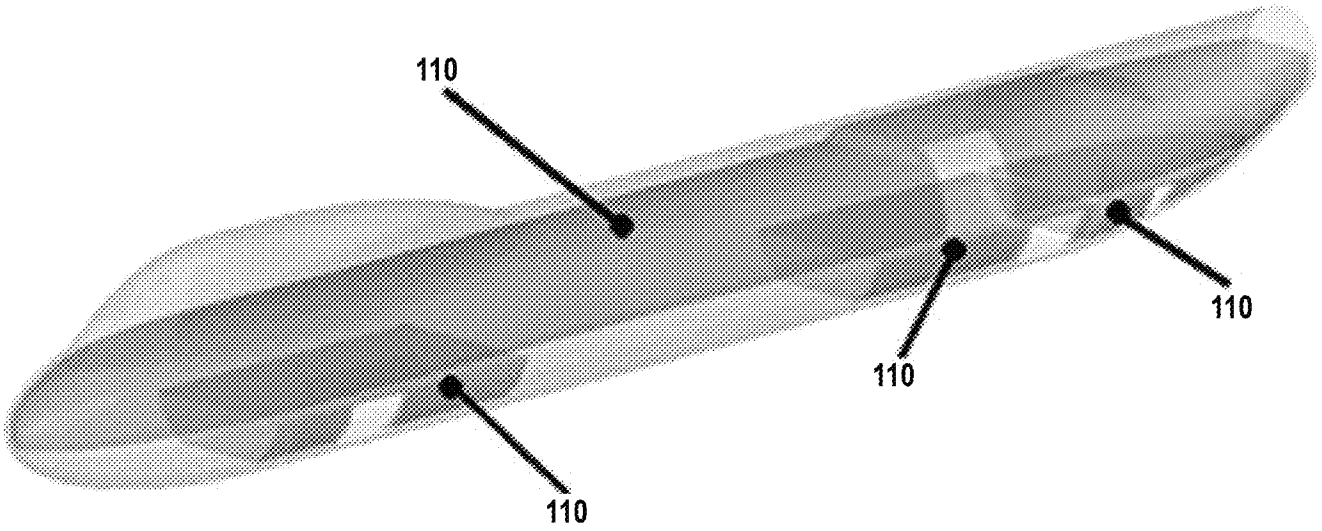
Figure 2:
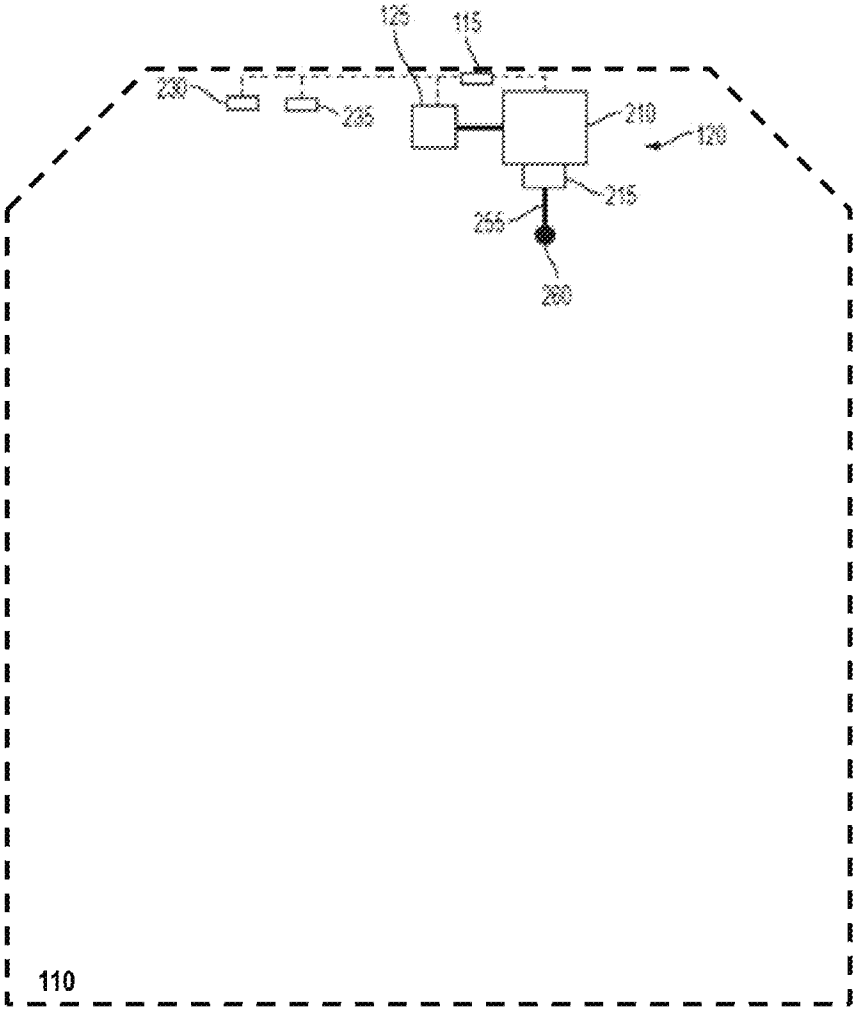

FIGS. 1 and 2 illustrate various details of a compartment fire-suppression system according to one embodiment of the present invention. Many of the features, dimensions, and other specifications shown in the figures are merely illustrative for purposes of this disclosure. Accordingly, other embodiments may have other features, dimensions, and specifications. In addition, other embodiments of the present invention may be practiced without various features as described below.

FIG. 1 provides a perspective view of an aircraft that includes one or more compartments 110 (one of which is shown in the FIG. 2). A compartment 110 may be an area of an aircraft configured to store cargo (e.g., shipments, packages, pallets, etc.) of varying shapes and sizes. As will be recognized, there can be various classes of compartments of aircraft, including Class A, Class B, Class C, Class D, Class E, and/or various other classes of compartments. By way of example, Section 25.857 of Title 14 the Code of Federal Regulations (CFR) describes illustrative classes. As will be recognized, though, embodiments of the present invention are not limited to any particular class or category of compartments. In a particular embodiment, Class C compartments may benefit from embodiments of the present invention. A Class C compartment may be a cargo or baggage compartment that does not meet the requirements for other classes and/or for which (1) there is a separate approved smoke detector or fire detector system to give warning at the pilot or flight engineer station; (2) there is an approved built-in fire extinguishing or suppression system controllable from the cockpit; (3) there are means to exclude hazardous quantities of smoke, flames, or extinguishing agent from any compartment occupied by the crew or passengers; and (4) there are means to control ventilation and drafts within the compartment so that the extinguishing agent used can control any fire that may start within the compartment. As will be recognized, various other approaches and techniques can be used to adapt to various needs and circumstances.

One or more fire detectors 125 in accordance with various embodiments of the present invention are provided in the compartment 110 configured to provide a signal to an aircraft system in response to detecting an actual or potential fire condition in a portion or area of the compartment 110. In particular embodiments, the control system 115 may be configured to provide a warning to one or more personnel (e.g., crew members) of the aircraft if one or more of the detectors 125 are activated. Illustrative notification/warning concepts are described in U.S. Publ. Appl. No. 2013-0120162, which is incorporated herein in its entirety by reference.

Further, in the embodiment of the aircraft shown in FIG. 2, the aircraft also includes a compartment fire-suppression system 120 mounted in the compartment 110. The compartment fire-suppression system 120 may be integrated into the aircraft flight management system and/or or various other aircraft systems. As will be recognized, there may be one or more fire-suppression systems 120 for each compartment of the aircraft mounted or otherwise positioned in different areas of the compartment. Thus, although the following examples refer to the fire-suppression system in the compartment, there may be one or more fire-suppression systems in each compartment and multiple compartments.

In various embodiments, the compartment fire-suppression system 120 may be in communication with the control system 115 and can be activated manually or automatically by the control system 115 in the event a fire condition is detected. In particular embodiments, the compartment fire-suppression system 120 is configured to disperse an extinguishing agent into the compartment 110 (e.g., into the entire compartment or into a portion or area of the compartment in which a potential fire condition was detected) upon activation. In particular embodiments, the fire-suppression system may use liquefied gas in pressurized containers (e.g., bottles) or a solid compound which generates an aerosol containing potassium compounds.

Typically, the extinguishing agent is dispersed into the compartment 110 (e.g., into the entire compartment or into a portion or area of the compartment in which a potential fire condition was detected) at a high concentration level to extinguish any flame that may be present. However, in particular embodiments, the extinguishing agent may also be dispersed into the compartment 110 over an extended period of time in order to maintain a particular concentration level of the extinguishing agent to help prevent subsequent flare-ups.

Turning now to FIG. 2, a schematic view of compartment fire-suppression system 120 is provided according to various embodiments of the present invention. In the particular embodiment shown in FIG. 2, the compartment fire-suppression system 120 includes one or more discharge lines 255 configured to release a flow of an extinguishing agent within the compartment 110. The discharge lines 255 may function to disperse an extinguishing agent into the entire compartment or into a portion or area of the compartment in which a potential fire condition was detected. One or more discharge nozzles 260 are located at the terminal ends of the one or more discharge lines 255 and the discharge nozzles 260 are configured to dispense the extinguishing agent into the compartment.

Further, in particular embodiments, the compartment fire-suppression system 120 includes one or more pressurized containers 210 holding extinguishing agent and connected to the one or more discharge lines 255. The containers 210 may be strategically located throughout the compartment to disperse an extinguishing agent into the entire compartment or into a portion or area of the compartment in which a potential fire condition was detected. According to various embodiments, the pressurized containers 210 may be configured to quickly discharge an extinguishing agent into the discharge lines 255 for delivery to the compartment 110 (e.g., into the entire compartment or into a portion or area of the compartment in which a potential fire condition was detected) in response to the compartment fire-suppression system 120 being activated. According to various embodiments, activation of the fire-suppression system 120 may be provided by detection of heat, smoke, flames, combustion products (such as carbon monoxide, for example), or combination thereof—also referred to herein as potential fire conditions, actual fire conditions, fire conditions, and/or similar words.

In particular embodiments, the pressurized containers 210 may include one or more valve mechanisms 215 with a valve setting that allows the containers 210 to fully discharge the agent into the discharge lines 255 over a very short period of time. Thus, in these particular embodiments, the extinguishing agent from the containers 210 may be dispensed from the discharge nozzles 260 in a high concentration into the compartment 110.

Further, in particular embodiments, one or more of the pressurized containers 210 may be configured to discharge extinguishing agent into the discharge lines 255 at a controlled rate. These particular containers 210 may be used to maintain a particular concentration level of an extinguishing agent in the compartment 110 after the initial high concentration level of agent has been discharged into the compartment 110 (e.g., into the entire compartment or into a portion or area of the compartment in which a potential fire condition was detected). In various embodiments, these containers 210 may be activated at a predetermined time after the high concentration discharge of the extinguishing agent by the control system 115 to dispense the extinguishing agent into the compartment 110 (e.g., into the entire compartment or into a portion or area of the compartment in which a potential fire condition was detected) at a controlled discharge rate over an elongated period of time. Typically, the controlled discharge rate is substantially less than the high concentration discharge rate so that the concentration of the extinguishing agent present in the compartment 110 may be maintained at a constant level over an extended period of time. In order to achieve the controlled discharge rate, one or more of the pressurized containers 210 may be coupled to at least one regulator that controls the flow of the extinguishing agent to the compartment 110. In particular embodiments, the regulator is a component of the valve mechanism 215

Finally, in particular embodiments, one or more of the pressurized containers 210 may be configured to provide a second high concentration level discharge of the extinguishing agent (e.g., into the entire compartment or into a portion or area of the compartment in which a potential fire condition was detected) upon the aircraft beginning its descent. For instance, in various embodiments, these particular pressurized containers 210 may be activated to quickly discharge extinguishing agent into the discharge lines 255 for delivery to the compartment 110 as the aircraft begins to make its descent toward landing. As a result, the extinguishing agent is delivered to the compartment 110 (e.g., into the entire compartment or into a portion or area of the compartment in which a potential fire condition was detected) at a greater rate during the descent of the aircraft as compared to the rate at which the agent is delivered from the pressurized containers 210 prior to descent.

It should be understood by those of ordinary skill in the art that the compartment fire-suppression system 120 may be configured to use different extinguishing agent distribution configurations according to various embodiments. For instance, various embodiments of the compartment fire-suppression system 120 may utilize all three types of distributions in order to control a fire. That is, various embodiments of the compartment fire-suppression system 120 may provide a first high concentration level discharge of the extinguishing agent, followed by a controlled concentration level discharge of the extinguishing agent, followed by a second high concentration level discharge of the extinguishing agent upon the aircraft beginning its decent. While other embodiments of the compartment fire-suppression system 120 may only utilize the first high concentration level discharge of the extinguishing agent and the second high concentration level discharge of the extinguishing agent without providing the controlled concentration level discharge of the extinguishing agent. One of ordinary skill in the art can envision other configurations in light of this disclosure.

Figure 7:
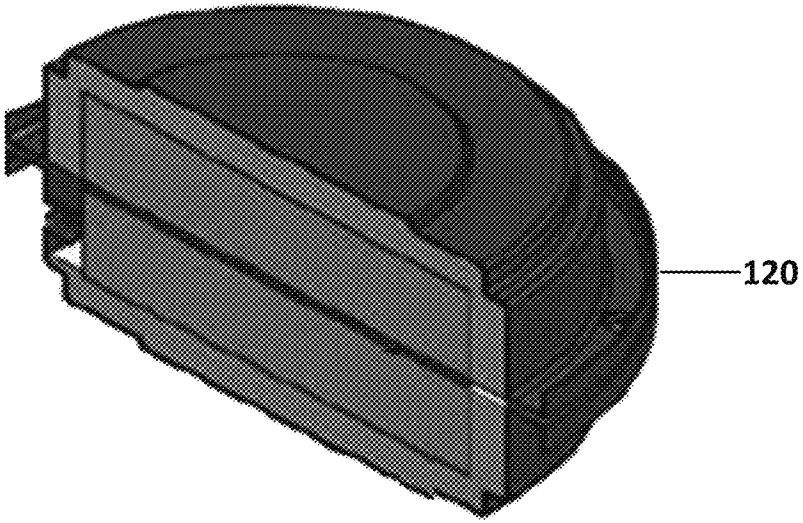
Figure 8:
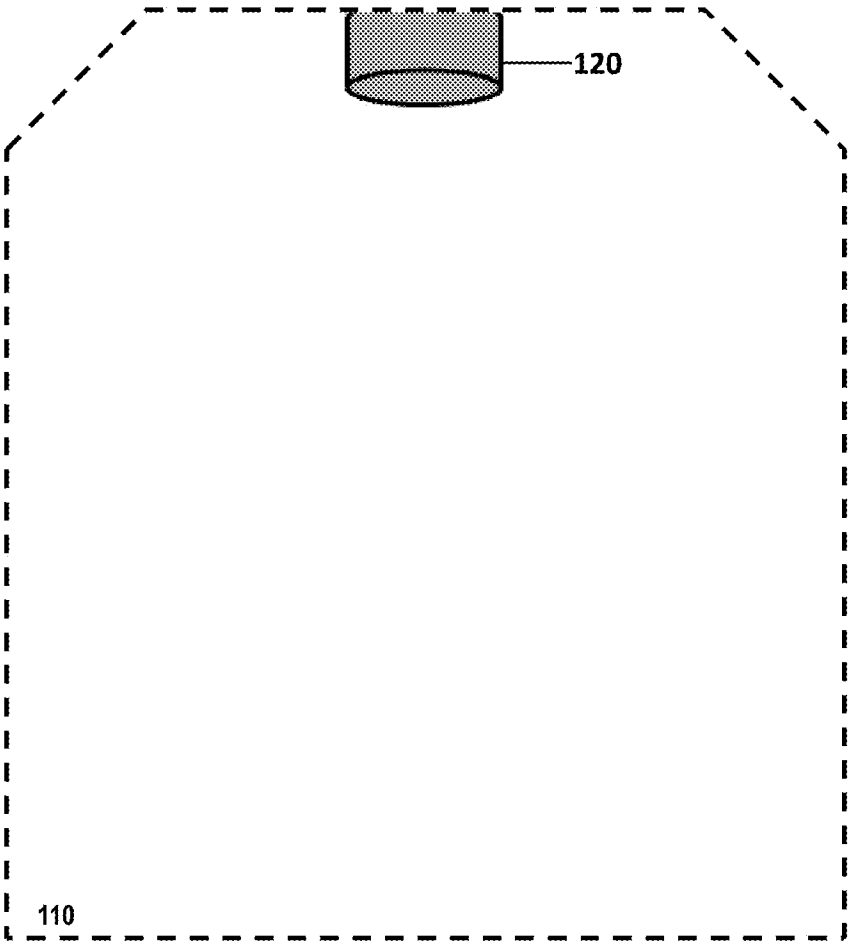

In another embodiment, such as the embodiment shown in FIGS. 7 and 8, the compartment fire-suppression system 120 may include an enclosure housing a solid aerosol forming material that is configured to expel or disperse an aerosol and other off gasses in response to an ignition signal (also referred to as extinguishing agents). In various embodiments, the compartment fire-suppression system 120 includes a bottom container and a top cover organized in a "clam-shell" arrangement to form an enclosure. The bottom container and top cover may include a metal or other heat resistant outer layer with an insulating inner layer. In various embodiments, flanges may be provided proximate the interface between the bottom container and top cover to facilitate attachment of the top cover to the bottom container via welding, fasteners, or other attachment techniques.

In various embodiments, as shown in FIG. 7, the compartment fire-suppression system 120 includes a discharge outlet which provides a communication pathway from inside the enclosure to the atmosphere outside the enclosure. The discharge outlet may be disposed in the bottom container, the top cover, or at the interface between the bottom container and the top cover. In various embodiments, a solid aerosol forming material, including inorganic potassium salts and the like, may be housed within the enclosure formed by the bottom container and top cover. In various embodiments, the solid aerosol forming material is configured to create potassium powder aerosol, CO2, Nitrogen, and water vapor (e.g., extinguishing agent) in response to an ignition signal upon detecting an actual or potential fire condition in a portion or area of the compartment 110. This material may be expelled or dispersed through the discharge outlet. In this example, one or more compartment fire-suppression systems 120 may be mounted in various areas throughout one or more compartments 110. In this embodiment, retrofitting an existing aircraft would allow removal of a Halon system equipment, including nozzles, plumbing, pressurized containers, solenoid valves, etc.

In one embodiment, the compartment fire-suppression system 120 may be integrated into the aircraft flight management system and/or or various other aircraft systems. Thus, to create the ignition signal, the compartment fire-suppression system 120 may include a pyrotechnic electrical ignition device in communication with the solid aerosol forming material. In some embodiments, the ignition device may be mounted through the bottom container and extend into/proximate to the aerosol generating material. In various embodiments, an ignition signal may be generated (e.g., a signal voltage) (1) automatically by a local or remote sensor or (2) based on input from a user as describe below in conjunction detecting an actual or potential fire condition in a portion or area of the compartment 110. The ignition signal may be communicated to the pyrotechnic ignition device via a wired or wireless connection, and in response to the signal (as a result from a signal from the aircraft flight management system, controller system, fire detection systems, various other aircraft systems, and/or the like), the pyrotechnic device may initiate a catalytic process within the solid aerosol forming material. The catalytic process forms an aerosol and other gases (e.g., extinguishing agents) that may be expelled through the discharge outlet.

As indicated, in various embodiments, the compartment fire-suppression system 120 may be in communication with a fire-detection system (or various other systems, including aircraft flight management systems, controller systems, and/or the like) that may comprise one or more fire detectors 125 configured to provide a signal to a compartment fire-suppression system 120 in response to detecting an actual or potential fire condition in a portion or area of the compartment 110. For instance, as previously mentioned detecting a potential fire condition may include detecting the presence of heat, flames, smoke, combustion products, or combinations thereof.

In either embodiment, these fire detectors 125 may be placed throughout the compartment 110. Additionally, in the embodiment shown in FIG. 2, the compartment fire-suppression system 120 may include a pressure switch 230. The pressure switch 230 may be in communication with the control system 115 and may be triggered by the control system 115 during the process for suppressing a fire detected in the compartment 110. Finally, in the embodiment shown in FIG. 2, the compartment fire-suppression system 120 may include a timing circuitry 235. As is explained in greater detail below, the timing circuitry 235 is used in various embodiments to trigger a discharge of an extinguishing agent into the compartments.

Exemplary Methods for Suppressing a Fire

Figure 3:
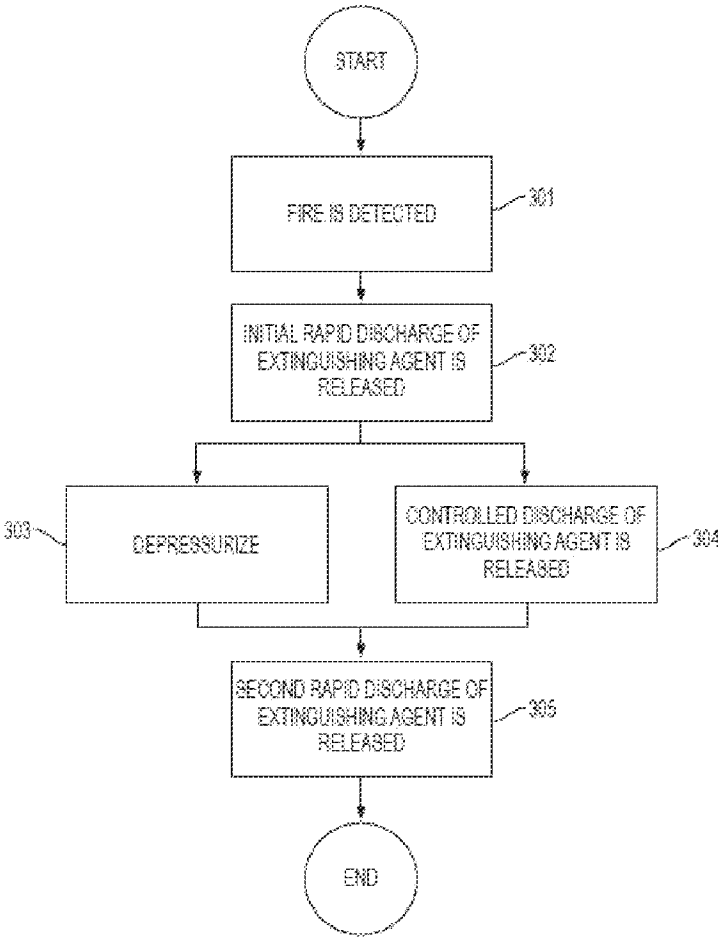
FIG. 3 illustrates a method of suppressing a fire according to an embodiment of the present invention.
Figure 4:
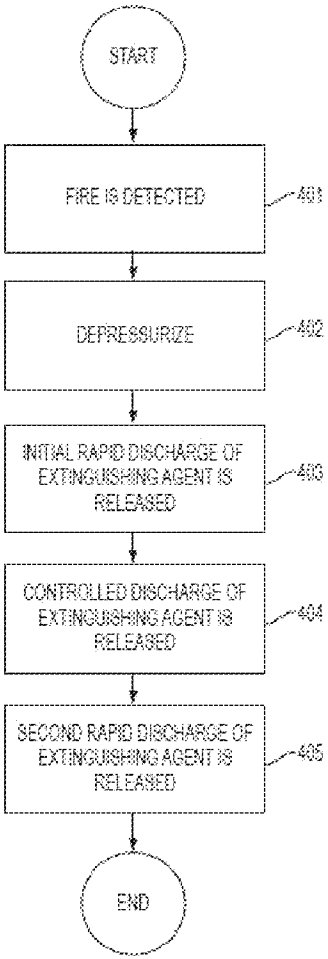
FIG. 4 illustrates another method of suppressing a fire according to an embodiment of the present invention.

FIGS. 3 and 4 provide methods for suppressing a fire according to various embodiments of the present invention. FIG. 3 begins with detecting a presence of an actual or potential fire condition in a portion or area of the compartment 110, shown as Step 301. For instance, in particular embodiments, a fire condition is detected in the compartment 110 of the aircraft with an automatic device such as one or more fire detectors 125 located throughout the compartment 110. In various embodiments, one or more of the fire detectors 125 notify the control system 115 of the compartment fire-suppression system 120 and the control system 115 notifies the aircraft crew of the fire condition.

In response, the crew may manually release the initial rapid discharge of an extinguishing agent into the compartment 110 or the compartment fire-suppression system 120 may automatically release the initial rapid discharge of the agent into the compartment, shown as Step 302. For instance, in the embodiment of FIG. 2, a crew member sitting in the cockpit of the aircraft may select a control button that can send a signal to the control system 115 (compartment fire suppression system 120). In response, the control system 115 may send a signal to the valve mechanisms 215 of one or more of the pressurized containers 210 holding the extinguishing agent, and the pressurized containers 210 may release extinguishing agent into the discharge lines 255 to be discharged into the compartment 110 (e.g., into the entire compartment or into a portion or area of the compartment in which a potential fire condition was detected). In another embodiment, the crew member may not be required to send a signal to the control system 115 (compartment fire suppression system 120). Instead, the control system 115 may automatically send the signal to the valve mechanisms 215 upon receiving the notification from the fire detectors 125 of the fire condition. In particular embodiments, the control system 115 may also activate a timing circuitry 235 in addition to sending the signal to the valve mechanisms 215.

In the embodiment of FIGS. 7 and 8, a crew member sitting in the cockpit of the aircraft may select a control button that can send a signal to the compartment fire-suppression system 120 that will create an ignition signal to cause the extinguishing agent to be expelled or dispersed through the discharge outlet.

After the initial rapid discharge of the extinguishing agent has been released into the compartment 110, in various embodiments, the aircraft is depressurized (which may refer to depressurizing the entire aircraft, the compartment of the aircraft, or the portion or area of the compartment in which a potential fire condition was detected), shown as Step 303. For instance, in one embodiment, a crew member receives an indication from the control system 115 that the initial rapid discharge of the extinguishing agent has been completed and the crew member follows the standard procedure for depressurizing the aircraft (which may refer to depressurizing the entire aircraft, the compartment of the aircraft, or the portion or area of the compartment in which a potential fire condition was detected).

As a result of depressurizing the aircraft (which may refer to depressurizing the entire aircraft, the compartment of the aircraft, or the portion or area of the compartment in which a potential fire condition was detected), the amount of oxygen available to the fire condition is reduced. Thus, in various embodiments, the depressurization of the aircraft supplements the compartment fire-suppression system 120. As a result, an advantage realized in various embodiments is the amount of extinguishing agent(s) needed to contain the fire condition is reduced because of the effect realized by reducing the amount of oxygen available to the fire condition. Further, a reduction in the amount of extinguishing agent(s) needed is also realized in various embodiments by using liquefied gas or a solid compound that generates an aerosol containing potassium compounds as the extinguishing agent.

Figure 5:
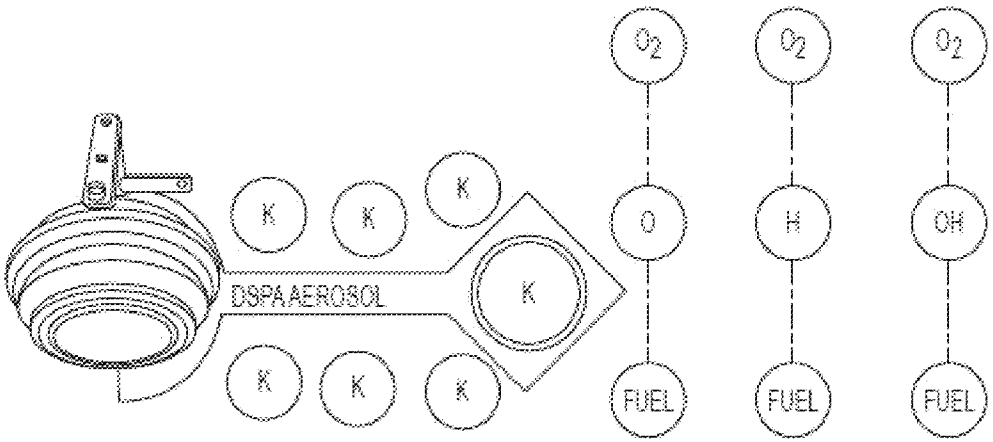
FIG. 5 illustrates the use of dry sprinkler powder aerosol as an extinguishing agent in various embodiments of the present invention.

FIGS. 5 and 6 provide details on one such aerosol using potassium compounds. As shown in FIG. 5, once the aerosol is discharged into the compartment, a negative catalytic reaction takes place. The potassium compounds bind with free radicals (e.g., hydroxyls) that are released during combustion. As further shown in FIG. 6, the resulting chemical reaction creates stable molecules. By creating stable molecules and eliminating the free radicals, the fire is suppressed and extinguished. Thus, in many instances, the use of liquefied gas and such a compound have been found to have superior properties for extinguishing fires over traditional extinguishing agents. Therefore, as a result, the weight of the extinguishing agent required for the compartment fire-suppression system 120 used onboard the aircraft may be reduced in comparison to the typical amount of weight of the agent required under typical fire-suppression procedures employed along with the compartment fire-suppression system 120.

Further, in various embodiments, the compartment fire-suppression system 120 may make use of a controlled discharge of the extinguishing agent into the compartment 110 (e.g., into the entire compartment or into a portion or area of the compartment in which a potential fire condition was detected), shown as Step 304. Depending on the embodiment, this step may be carried out prior to depressurizing the aircraft, after depressurizing the aircraft, or substantially at the same time to depressurizing the aircraft. Thus, in the embodiment shown in FIG. 2, the control system 115 of the compartment fire-suppression system 120 can send a signal to the valve mechanisms 215 of one or more of the pressurized containers 210 holding the extinguishing agent and the pressurized containers 210 release an extinguishing agent into the discharge lines 255 to be carried to one or more discharge nozzles 260 and released into the compartment 110 (e.g., into the entire compartment or into a portion or area of the compartment in which a potential fire condition was detected). In this particular instance, the control system 115 may also send a signal to one or more regulators located along the discharge lines 255 to regulate the flow of the extinguishing agent. Thus, as a result, the regulator facilitates a controlled concentration level discharge of the extinguishing agent into the compartment 110 (e.g., into the entire compartment or into a portion or area of the compartment in which a potential fire condition was detected). In the embodiment of FIGS. 7 and 8, the compartment fire-suppression system 120 that will create an ignition signal to cause the extinguishing agent to be expelled or dispersed through the discharge outlet.

In an instance in which the controlled discharge of the extinguishing agent follows the depressurization of the aircraft (which may refer to depressurizing the entire aircraft shown in FIG. 2, the compartment of the aircraft, or the portion or area of the compartment in which a potential fire condition was detected), the timing circuitry 235 (or aneroid switch, for instance) may activate an indicator after a sufficient time for depressurization in order to release the controlled discharge of the extinguishing agent. For example, in this particular instance, the timing circuitry 235 (or aneroid switch, for instance) may activate a pressure switch connected to the extinguishing agent delivery system. As a result, the pressure switch releases the controlled discharge of the extinguishing agent into the discharge lines 255 of the delivery system.

Finally, in Step 305 of the embodiment shown in FIG. 2, the compartment fire-suppression system 120 releases a second rapid discharge of the extinguishing agent into the compartment 110 upon detection that the aircraft has begun its descent for landing. In various embodiments, this step is accomplished by the control system 115 sending a signal to the valve mechanisms 215 of one or more of the pressurized containers 210 holding the extinguishing agent and the pressurized containers 210 releasing the extinguishing agent into the discharge lines 255 to be carried to one or more discharge nozzles 260 and released into the compartment 110 (e.g., into the entire compartment or into a portion or area of the compartment in which a potential fire condition was detected). Further, in particular embodiments, the control system 115 may also need to send a signal to the regulator. In the embodiment shown in FIGS. 7 and 8, a second discharge is not dispersed.

The indication that the aircraft is descending may be received by the control system 115 via various mechanisms. For instance, in one embodiment, a crew member (or aneroid switch, for instance) may set an indicator that can send a signal that the aircraft is beginning its descent. While in another embodiment, the aircraft flight management system can send a signal that the aircraft is beginning its descent.

FIG. 4 provides another method for suppressing a fire according to various embodiments of the present invention. In this particular method, the aircraft is depressurized (which may refer to depressurizing the entire aircraft, the compartment of the aircraft, or the portion or area of the compartment in which a potential fire condition was detected) prior to the compartment fire-suppression system 120 releasing extinguishing agent into the compartment 110 (e.g., into the entire compartment or into a portion or area of the compartment in which a potential fire condition was detected). Therefore, as a result, the discharge of the extinguishing agent in various embodiments may also realize the benefit of having less oxygen available for the fire condition present in the compartment 110.

As shown in FIG. 4, once the fire has been detected (shown as Step 401), the aircraft is initially depressurized (shown as Step 402). Once the depressurization of the aircraft has taken place, the compartment fire-suppression system 120 then releases extinguishing agent into the compartment 110 (e.g., into the entire compartment or into a portion or area of the compartment in which a potential fire condition was detected). For instance, as shown in FIGS. 4 and 2, the compartment fire-suppression system 120 may release an initial rapid discharge of the extinguishing agent into the compartment (shown as Step 403), followed by a controlled discharge of the extinguishing agent (shown as Step 404), followed by a second rapid discharge of the extinguishing agent once the aircraft has begun its descent (shown as Step 405). However, in the embodiment of FIGS. 7 and 8, the compartment fire-suppression system 120 can create an ignition signal to cause the extinguishing agent to be expelled or dispersed through the discharge outlet. This discharge may be the only discharge in the example for the embodiment shown in FIGS. 7 and 8.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A method for suppressing a fire condition in an aircraft, the method comprising the steps of:

detecting a presence of a fire condition in a compartment of an aircraft having an initial pressure;

after detecting the presence of the fire condition in the compartment of the aircraft, depressurizing the compartment of the aircraft from the initial pressure in accordance with a depressurizing procedure for the aircraft, wherein depressurizing the compartment of the aircraft reduces the amount of oxygen in the compartment;

after depressurizing the compartment of the aircraft, releasing a first rapid discharge of an extinguishing agent in the compartment of the aircraft; and after releasing the rapid discharge of the extinguishing agent, releasing a second controlled discharge of the extinguishing agent in the compartment of the aircraft;

wherein the extinguishing agent comprises a liquefied gas or a solid compound that generates an aerosol containing potassium compounds.

2. The method of claim 1, wherein the second controlled discharge of extinguishing agent is released once the aircraft has started a descent to land.

3. A method for suppressing a fire condition in an aircraft, the method comprising the steps of:

detecting a presence of a fire condition in a compartment of an aircraft;

after detecting the presence of the fire condition in the compartment of the aircraft, releasing a first discharge of an extinguishing agent in the compartment of the aircraft;

after releasing the first discharge of the extinguishing agent, depressurizing the compartment of the aircraft in accordance with a depressurizing procedure for the aircraft, wherein depressurizing the compartment of the aircraft reduces the amount of oxygen in the compartment; and after depressurizing the compartment of the aircraft, releasing a second discharge of the extinguishing agent in the compartment of the aircraft;

wherein the extinguishing agent comprises a liquefied gas or a solid compound that generates an aerosol containing potassium compounds.

4. The method of claim 3, wherein the first discharge of the extinguishing agent comprises a rapid discharge of the extinguishing agent in the compartment of the aircraft.

5. The method of claim 4, wherein the second discharge of the extinguishing agent comprises a controlled discharge of the extinguishing agent in the compartment of the aircraft.

* * * * *